US006019369A

United States Patent [19]

Nakagawa et al.

[11] Patent Number: 6,019,369

[45] Date of Patent: Feb. 1, 2000

[54] COMPETITIVE GAME SIMULATION MACHINE

[75] Inventors: Toshiaki Nakagawa; Takashi Yamaguchi, both of Zama; Kohichi Hayashida, Yamato, all of Japan

[73] Assignee: Konami Co., Ltd., Hyogo-ken, Japan

[21] Appl. No.: 08/692,211

[22] Filed: Aug. 5, 1996

[30] Foreign Application Priority Data

Aug. 7, 1995 [JP] Japan ..... 7-200691

[51] Int. Cl.[7] ..... A63F 9/22

[52] U.S. Cl. ..... 273/246; 274/237; 463/6; 463/25

[58] Field of Search ..... 463/1, 6, 16, 25, 463/29–31, 35–37, 40; 273/236–237, 246, 138.1, 138.2, 139, 459–461; 700/90–92

[56] References Cited

U.S. PATENT DOCUMENTS 4,874,177 10/1989 Girardin ..... 273/246

5,322,293 6/1994 Goyette ..... 273/246

FOREIGN PATENT DOCUMENTS

0516160A1 5/1992 European Pat. Off. .

0633045A2 6/1994 European Pat. Off. .

1-112490 8/1989 Japan .

*Primary Examiner*—Valencia Martin-Wallace

*Assistant Examiner*—Mark A. Sager

*Attorney, Agent, or Firm*—Jordan and Hanburg LLP

[57] ABSTRACT

A competitive game simulation machine includes a plurality of moving objects; a game board on which the plurality of moving objects are to be placed; and a controller for controlling motions of the moving objects on the game board. The game board includes a main area used for moving objects to compete a specified game and an auxiliary area wherein the moving objects are movable between the main area and the auxiliary area.

11 Claims, 9 Drawing Sheets

COMPETITIVE GAME SIMULATION MACHINE

BACKGROUND OF THE INVENTION AND RELATED ART STATEMENT

The present invention relates to a competitive game simulation machine in which moving objects resembling racehorses, automobiles, bicycles or soccer players, for example, are caused to compete in running a simulated race or in performing certain activities on a playing area resembling a racing track or field.

The prior art to which the invention is directed includes a racing game machine in which a plurality of moving objects resembling racehorses, automobiles or bicycles, for example, are caused to compete in specific forms of simulated race on a playing area and game players enjoy betting that a particular moving object will win the race by using tokens they own. In this kind of competitive game simulation machine, a plurality of moving objects are arranged in a playing area and each game is performed with all these moving objects participating.

In such conventional competitive game simulation machines, all available moving objects are deployed in a simulated playing area and are caused to participate in each game. This arrangement does not faithfully represent actual situations in competitive sport events though and, therefore, makes games played on the machines considerably lack in reality.

Although behaviors of individual contestants presented prior to an actual sport race serve as a reference in predicting race results (as in horse racing in which behaviors of racehorses in a paddock provide important information), the conventional competitive game simulation machines do not allow the players to use such in formation in making their predictions of the outcome of the race and this tends to make the game less interesting.

SUMMARY OF THE INVENTION

The invention overcomes the aforementioned problems of the conventional competitive game simulation machines. It is an object of the invention to provide a competitive game simulation machine which can offer realistic sensations and more fun by making it possible to simulate competitive games in a manner that they are organized and performed in actual situations.

A competitive game simulation machine according to the this invention comprises a plurality of moving objects; a game board on which the plurality of moving objects are to be placed; and a controller for controlling motions of the moving objects; the game board including a main area used for moving objects to compete a specified game and an auxiliary area, and the moving objects movable between the main area and the auxiliary area and a controller for controlling m otions of the moving objects on the game board.

In the competitive game simulation machine thus constructed, the auxiliary area provides a waiting place for those moving objects which are not currently participating in the specified game event. The auxiliary area also serves as a space where the individual moving objects can demonstrate their behavioral characteristics and change their moving directions. This provides increased variety in simulating competitive games.

Control operation of the controller may be set such that it causes those moving objects which will participate in a next simulated sport event (or the specified game) to move to the main area (or playing area) and the remaining moving objects to stay within the auxiliary area.

With this arrangement, the controller (or a moving object controller) can designate an appropriate number of moving objects which will participate in each simulated game and keep non-participating moving objects in a standby state within the auxiliary area. Since the playing area can be cleared of the non-participating moving objects, it is possible to perform each game without sacrificing the reality of simulation. The capability of altering the number of participating moving objects further adds to the variety of simulated events.

In one aspect of this invention, a track may be formed in the playing area to make it easy to simulate racing events in a realistic manner. Preferably, the auxiliary area has a sufficient space to permit the moving objects to change their orientations.

This arrangement is particularly convenient when a track event is simulated in the playing area. If the auxiliary area has a sufficient space to allow the moving objects to alter their orientations, then it is possible to reverse their running direction on a track. This would increase the number of available racecourses to choose on the game board.

In another aspect of the invention, the auxiliary area has a waiting zone in which moving objects not participating in the simulated sport event can be kept in a standby state.

With this arrangement, it is possible to move the non-participating moving objects from the playing area to the auxiliary area and accommodate them in an orderly line in the waiting zone. This would be effective in keeping both the playing area and auxiliary area on the game board in good order.

In still another aspect of the invention, a passageway is formed between the playing area and the auxiliary area and through the passageway the moving objects can move between the playing area and the auxiliary area.

The passageway facilitates movement of the moving objects between the playing area and the auxiliary area.

In still another aspect of the invention, the waiting zone is arranged parallel to a linear boundary between the playing area and the auxiliary area and includes a plurality of waiting spaces in which the moving objects not participating in the simulated sport event are aligned side by side in a longitudinal direction of the waiting zone, and a looping paddock course surrounding the waiting zone is formed in the auxiliary area and the paddock course includes an exit-side portion which is closer to the boundary between the playing area and the auxiliary area and an entrance-side portion located opposite to the exit-side portion, wherein the controller causes moving objects leaving the waiting zone to proceed to the playing area by way of the exit-side portion of the paddock course and moving objects returning to the waiting zone to proceed thereto by way of the entrance-side portion of the paddock course.

The provision of the looping paddock course makes it possible to cause the moving objects to move relatively long distances, enabling players of each game to better observe behaviors of the moving objects.

This arrangement helps prevent the moving objects leaving the waiting zone and those returning to the waiting zone from taking intersecting courses, thereby ensuring their smooth movements in the waiting zone.

In a further aspect of the invention, the controller causes the moving objects returning to the waiting zone to sequentially enter those waiting spaces which are empty and closest to the center of the waiting zone.

With this arrangement, waiting spaces near both ends of the waiting zone would always be left unoccupied. Such empty waiting spaces can be used as passages by the moving objects and help ensure smooth movements of the moving objects within the waiting zone.

In another aspect of this invention, the controller can be set such that moving objects in the auxiliary area are capable of moving at different speeds from each other.

With this arrangement, the moving objects in the auxiliary area can demonstrate their physical strength by way of the speeds of their movements. Thus the players in the game could take into the consideration the result of the observation as to how the moving objects move in the auxiliary area when betting the money on the moving object(s) in each game. Of course the speeds of the moving objects in the auxiliary area are not necessarily set directly proportional to the speeds the moving objects can achieve at the game. It, however, would give some hints to the players on which moving object(s) he/she should bet. This, as a result, enhances realistic feeling of the players in participating the game. It could certainly make each game more realistic and enjoyable.

In one preferred form of the invention, the moving objects are formed in shapes resembling actual racehorses. Thus the specified game event may be a horse racing game. This arrangement, combined with the foregoing aspects of the invention, enables the competitive game simulation machine to simulate remarkably interesting and realistic horse races.

Having now summarized the invention, other objects, features and advantages thereof will become more apparent from the following detailed description and the accompanying drawings.

DETAILED DESCRIPTION OF THE PREFERRED EMBODIMENT OF THE INVENTION

Figure 1:
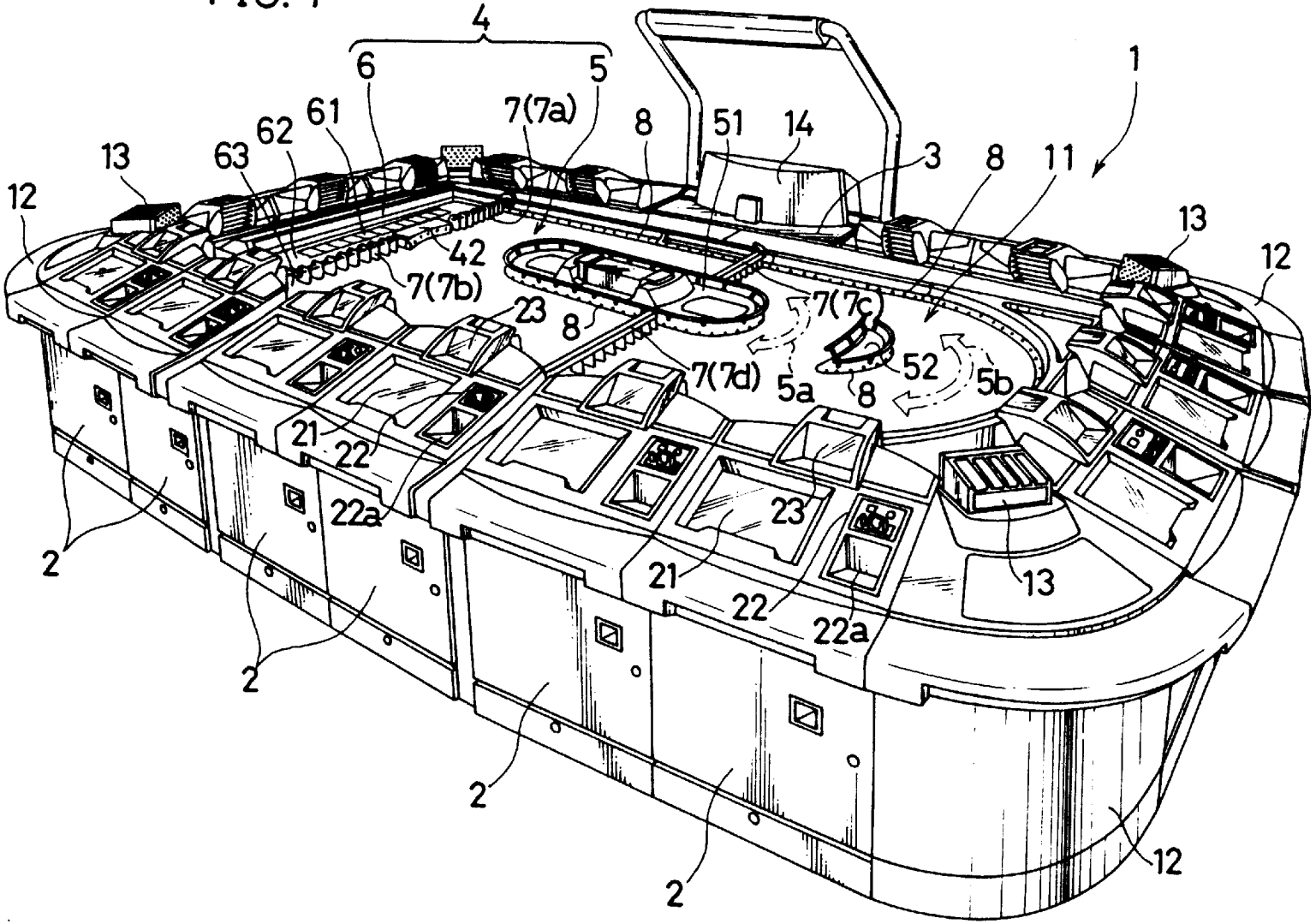
FIG. 1 is a perspective view of a competitive game simulation machine according to an embodiment of the invention.

FIG. 1 is a perspective view of a competitive game simulation machine 1 according to an embodiment of the invention, in which the competitive game simulation machine 1 includes a plurality of moving objects resembling racehorses. As shown in FIG. 1, the competitive game simulation machine 1 comprises a table-like main body 11, a plurality of playing consoles 2 arranged around the main body 11 and a control unit 3 provided at a lower internal position between a particular pair of playing consoles 2. The control unit 3 controls the operation of the whole competitive game simulation machine 1. The main body 11 has on its top surface a game board representing a playing field 4 which includes a track (playing area) 5 and a paddock (auxiliary area) 6.

At four corners of the main body 11 of the competitive game simulation machine 1, there are provided corner consoles 12, each having a fanlike shape in plan view. As the main body 11 is surrounded by the four corner consoles 12 and a specific number of playing consoles 2, the competitive game simulation machine 1 enables a plurality of players positioned around the main body 11 to participate together in a game. This construction provides the competitive game simulation machine 1 with a good external appearance as well.

Each of the playing consoles 2 has a slanted top panel of which inclination is increased at a rear portion (as viewed from a player). A horse entry indicator 21 including a cathode ray tube (hereinafter referred to as CRT) is provided at the left of the slanted top panel while a token slot 22 and the token dispensing tray 22a are provided at the right thereof. In addition, there is provided a horse data indicator 23 including a CRT at an uppermost part of the slanted top panel for displaying information on simulated horses H entered for a race. The participating players utilize the information presented on the horse data indicators 23 as a reference for determining their bets.

The screen of each horse entry indicator 21 is covered with a transparent touch panel. As a player inserts a desired number of tokens in the token slot 22 and touches an appropriate portion of the touch panel at his or her playing console 2 to specify a horse number which is displayed on the screen of horse entry indicator 21. For instance, with reference to FIGS. 4 and 5, information on the player's choice of a particular horse H is entered into a controller 31 incorporated in the control unit 3. Each of the corner consoles 12 is provided with a speaker 13 at a topmost position for generating sound effects including various kinds of imitation sounds and simulated announcements. In the middle of one long side of the competitive game simulation machine 1, there is provided a CRT video screen 14 at a slightly raised position to enable all the participating players to see video images presented, which are typically scenes of actual horse racing prerecorded by a video camera in a public racetrack. The images shown on the video screen 14 serve to create a vivid and realistic atmosphere.

When the players positioned at the individual playing consoles 2 insert desired numbers of tokens in the token slots 22 and enter their bets by touching desired horse numbers displayed on the respective horse entry indicators 21, for instance, with reference to odds and other information displayed on the horse data indicators 23, it is regarded that betting ticket purchasing operation has been completed. In this embodiment, the horse entry indicators 21 allow the players to choose win bets, forecast bets or other forms of betting through menu-assisted operation. When all the players have finished the betting ticket purchasing operation, or when a preset betting ticket purchasing time has elapsed, the simulated horses H (see FIGS. 4 and 5)are caused to start off and run along a specified course in the track 5 under the control of the control unit 3. The players receive returns, or "payoffs," at the end of the race depending on the correctness of their betting. These payoffs are delivered to the players in the form of tokens through token dispensing trays 22*a* provided beneath the individual token slots 22, and the number of tokens returned to each player is determined in accordance with the odds.

Figure 2:
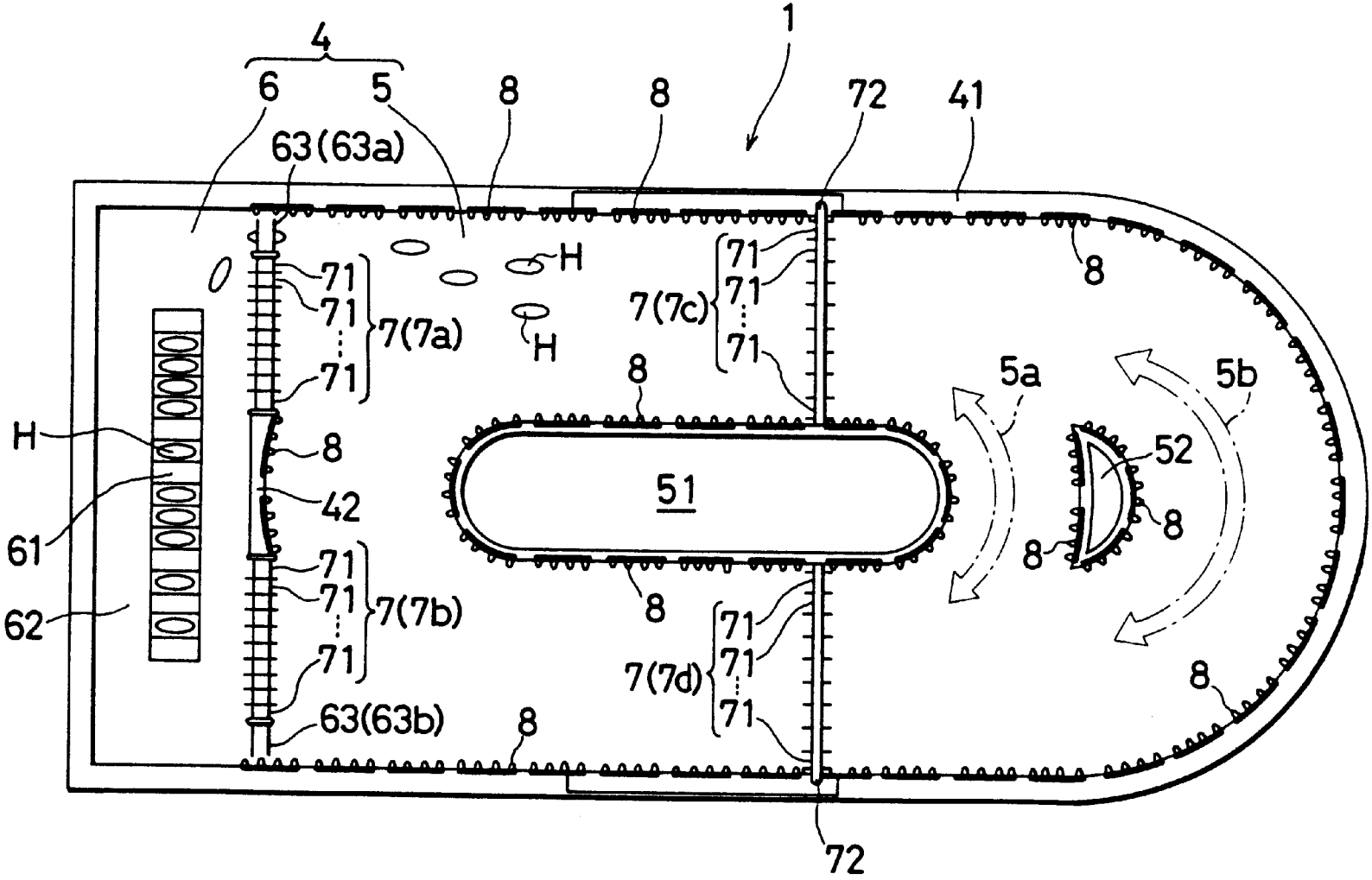
FIG. 2 is a plan view illustrating one form of a simulated playing field provided on the top surface of a main body of the competitive game simulation machine according to the embodiment.

FIG. 2 is a plan view illustrating one form of the field 4 provided on the top surface of the main body 11 of the competitive game simulation machine 1 according to the embodiment. Provided in the middle of the field 4 is a generally oval-shaped central separating zone 51 which extends in a longitudinal direction of the field 4 in plan view. The track 5 on which the simulated horses H are run is formed between the periphery of the central separating zone 51 and that of the top surface of the main body 11 of the competitive game simulation machine 1. The track 5 occupies most part of the field 4 and the paddock 6 is formed to the left of the track 5.

A right-hand curved portion of the track 5 has a larger width than its other portions and there is formed a crescent-shaped separating zone 52 approximately in the middle of right-hand curved portion of the track 5. The separating zone 52 is shaped such that its outer, or right-hand, convex edge faces a right-hand curved edge of the track 5 to form part of a long-distance track 5*b* therebetween whereas an inner, or left-hand, concave edge of the separating zone 52 faces a right-hand curved edge of the central separating zone 51 to form part of a short-distance track 5*a* therebetween. The above-described field 4 has all along its outer edges an upright bank 41, which separates the field 4 from other elements on the top surface of the main body 11 of the competitive game simulation machine 1.

There is provided a partition 42 in the middle of a boundary between the track 5 and paddock 6 and a pair of starting gates 7 (first starting gate 7*a* and second starting gate 7*b*) are connected to both ends of the partition 42. There are provided another pair of starting gates 7 (third starting gate 7*c* and fourth starting gate 7*d*), extending across the track 5 from appropriate points on straight edges of the central separating zone 51 at right angles thereto. A course actually used in a race is determined depending on which starting gate 7 the simulated horses H are started from and whether the race is run over the short-distance track 5*a* or long-distance track 5*b*.

Among the starting gates 7 mentioned above, the third starting gate 7*c* and fourth starting gate 7*d* are made individually rotatable about upright poles 72 provided on the bank 41. The third starting gate 7*c* and fourth starting gate 7*d* are turned around the respective upright poles 72 and individually stored in recessed storage spaces when not in use to clear the track 5. In this embodiment, each of the starting gates 7 has ten starting booths 71 into which the individual horses H are entered before the race is started. FIG. 2 depicts a situation where some horses H which have left the paddock 6 are proceeding toward the third starting gate 7*c* to make themselves ready to start from that gate.

A number of racecourse guide lamps 8 are arranged all along an inside wall of the bank 41, the periphery of the central separating zone 51 and the outer convex edge and inner concave edge of the separating zone 52, all facing the track 5. Those racecourse guide lamps 8 which are located along the course to be currently used sequentially flash in a wavy form moving in one direction so that the players can easily recognize the course and running direction of the horses H.

The competitive game simulation machine 1 offers 12 kinds of optional racecourses as shown in Table 1. It is possible to choose one of these racecourses depending on which starting gate 7 is used, whether the race is run over the short-distance track 5*a* or long-distance track 5*b*, and whether the horses H run clockwise or counterclockwise. There is a choice between two finish lines individually provided at approximately the midpoints of opposing straight sections of the track 5 to allow for either clockwise or counter clockwise running direction. No matter which starting gate 7 is selected, each horse H entered for the race is caused to run at least one complete round of the track 5 before finishing.

TABLE 1

| Course | Starting gate | | | | Track length | | Direction | |
|---|---|---|---|---|---|---|---|---|
| | 1st | 2nd | 3rd | 4th | Short | Long | | |
| No. | (7a) | (7b) | (7c) | (7d) | (5a) | (5b) | CW | CCW |
| 1 | ' | | | | ' | | ' | |
| 2 | ' | | | | | ' | ' | |
| 3 | | ' | | | ' | | | ' |
| 4 | | ' | | | | ' | | ' |
| 5 | | | ' | | ' | | ' | |
| 6 | | | ' | | ' | | | ' |
| 7 | | | ' | | | ' | ' | |
| 8 | | | ' | | | ' | | ' |
| 9 | | | | ' | ' | | ' | |
| 10 | | | | ' | ' | | | ' |
| 11 | | | | ' | | ' | ' | |
| 12 | | | | ' | | ' | | ' |

In the present embodiment, the simulated horses H are divided into groups of the following six colors: white, black, red, blue, yellow and green. Further, races may be run by six, eight or ten simulated horses H and serial horse numbers are assigned to individual horses H entered in each race. These serial horse numbers are predetermined by setting code numbers on dual-inline package (hereinafter referred to as DIP) switches provided in guiding vehicles which carry the individual horses H, wherein each DIP switch has at least four switch segments. To allow for such variations in performing simulated races, sixteen horses H enclosed by thick lines in Table 2 are made available in this embodiment.

TABLE 2

| Horse color | | Horse colors and numbers | | | | | |
|---|---|---|---|---|---|---|---|
| | | White | Black | Red | Blue | Yellow | Green |
| Type of race | 6-horse race | 1 | 2 | 3 | 4 | 5 | 6 |
| | 8-horse race | 1 | 2 | 3 | 4 | 5 | 7 |
| | | | | | | 6 | 8 |
| | 10-horse race | 1 | 2 | 3 | 5 | 7 | 9 |
| | | | | 4 | 6 | 8 | 10 |

As shown in Table 2, horse No. 1 in white, horse No. 2 in black, horse No. 3 in red, horse No. 4 in blue, horse No. 5 in yellow and horse No. 6 in green are entered for a six-horse race; horse No. 1 in white, horse No. 2 in black, horse No. 3 in red, horse No. 4 in blue, horse No. 5 in yellow, horse No. 6 in yellow, horse No. 7 in green and horse No. 8 in green are entered for an eight-horse race; and horse No. 1 in white, horse No. 2 in black, horse No. 3 in red, horse No. 4 in red, horse No. 5 in blue, horse No. 6 in blue, horse No. 7 in yellow, horse No. 8 in yellow, horse No. 9 in green and horse No. 10 in green are entered for a ten-horse race. The simulated horses H entered are lined up and made ready to start from appropriate booths 71 in one of the starting gates 7 at the beginning of each race.

Figure 3:
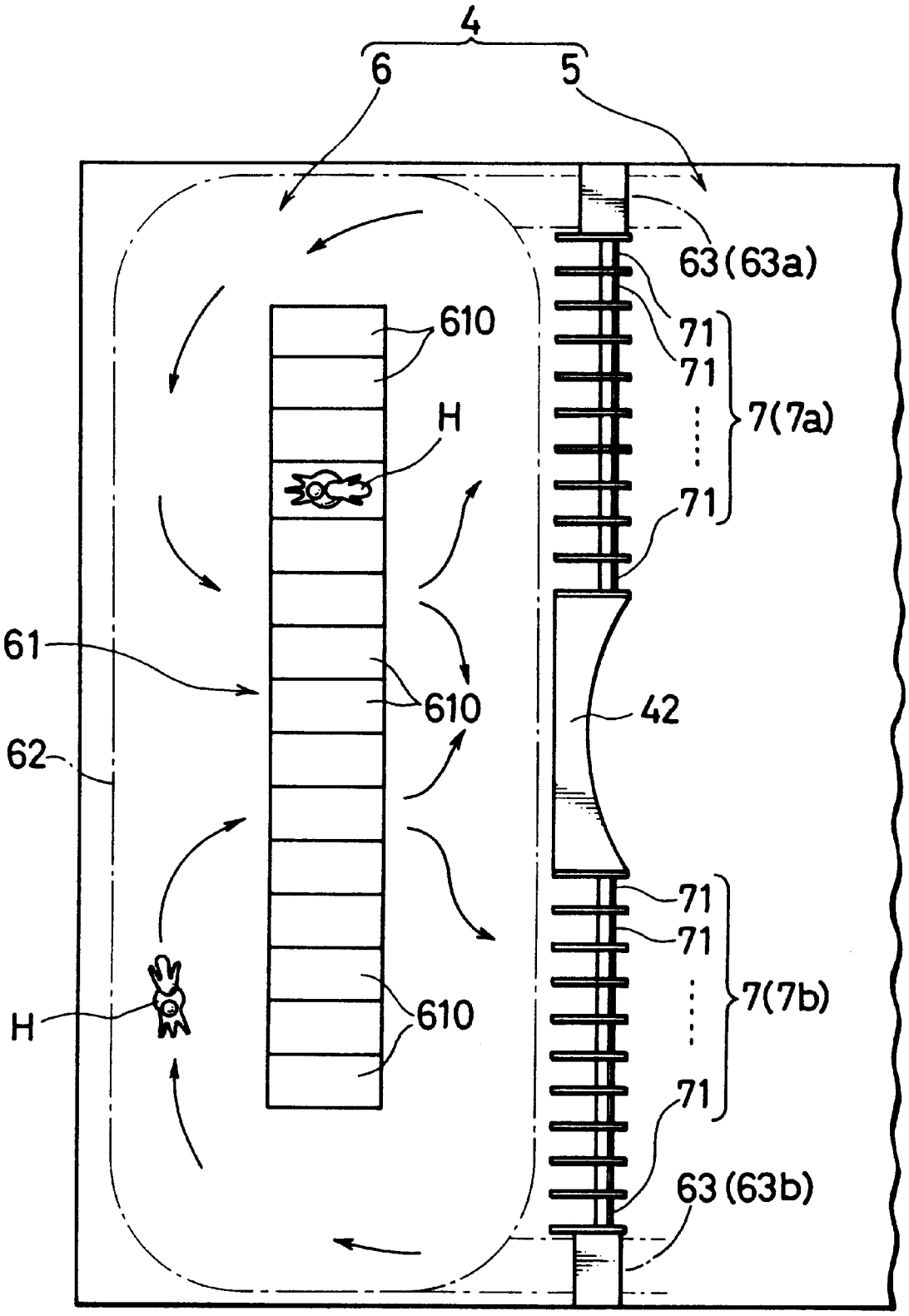
FIG. 3 is a fragmentary enlarged view particularly illustrating a paddock area.

FIG. 3 is a fragmentary enlarged view particularly illustrating the paddock 6. As depicted in this enlarged view, the paddock 6 has at its middle position a waiting zone 61 which is divided into sixteen waiting spaces 610 and surrounded by a looping course (or paddock course) 62. There are provided a pair of passageways 63 (first passageway 63*a* and second passageway 63*b*) for connecting the track 5 and paddock 6 at the outermost ends of the first starting gate 7*a* and second starting gate 7*b*.

The individual horses H are so controlled that they can move between the track 5 and paddock 6 through the passageways 63 and enter the waiting zone 61 through the looping course 62. There is made an arrangement to allow each horse H to enter the waiting zone 61 from its rear side (left-hand entrance side of the looping course 62 as illustrated in FIG. 3) and to leave the waiting zone 61 from its front side (right-hand exit side of the looping course 62 as illustrated). This arrangement is intended to prevent collisions between horses H proceeding to one of the starting gates 7 for participating in a next race and those returning to the waiting zone 61 after running a preceding race.

An additional arrangement is made to cause the horses H proceeding to the waiting zone 61 to sequentially enter those waiting spaces 610 which are empty and closest to the center of the waiting zone 61. This arrangement is meant to leave waiting spaces 610 close to both ends of the waiting zone 61 unoccupied as much as possible for permitting easy passage around the looping course 62 by the horses H returning to the waiting zone 61.

Figure 4:
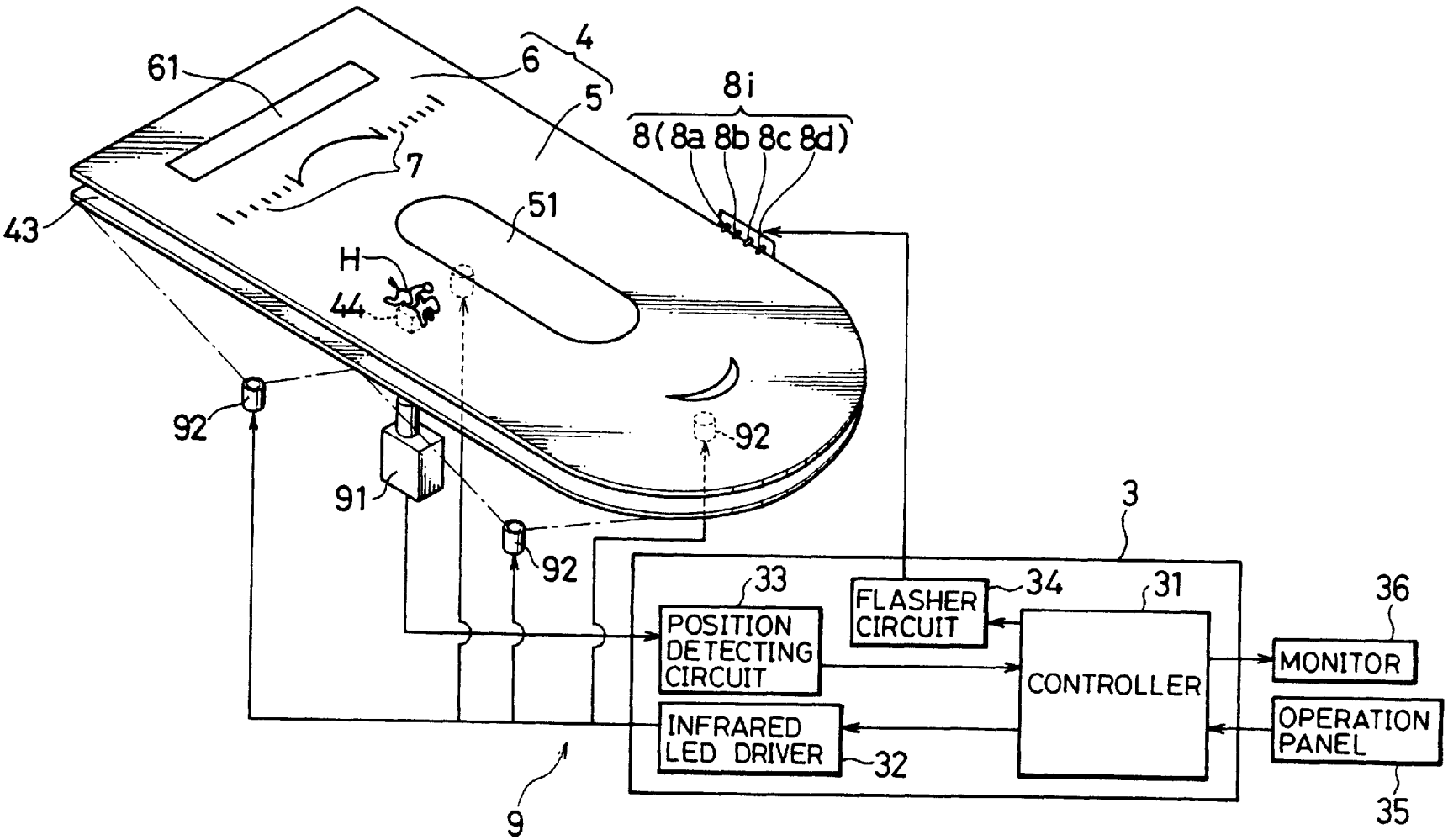
FIG. 4 is a diagram generally illustrating a mechanism for moving simulated horses within the simulated field.
Figure 5:
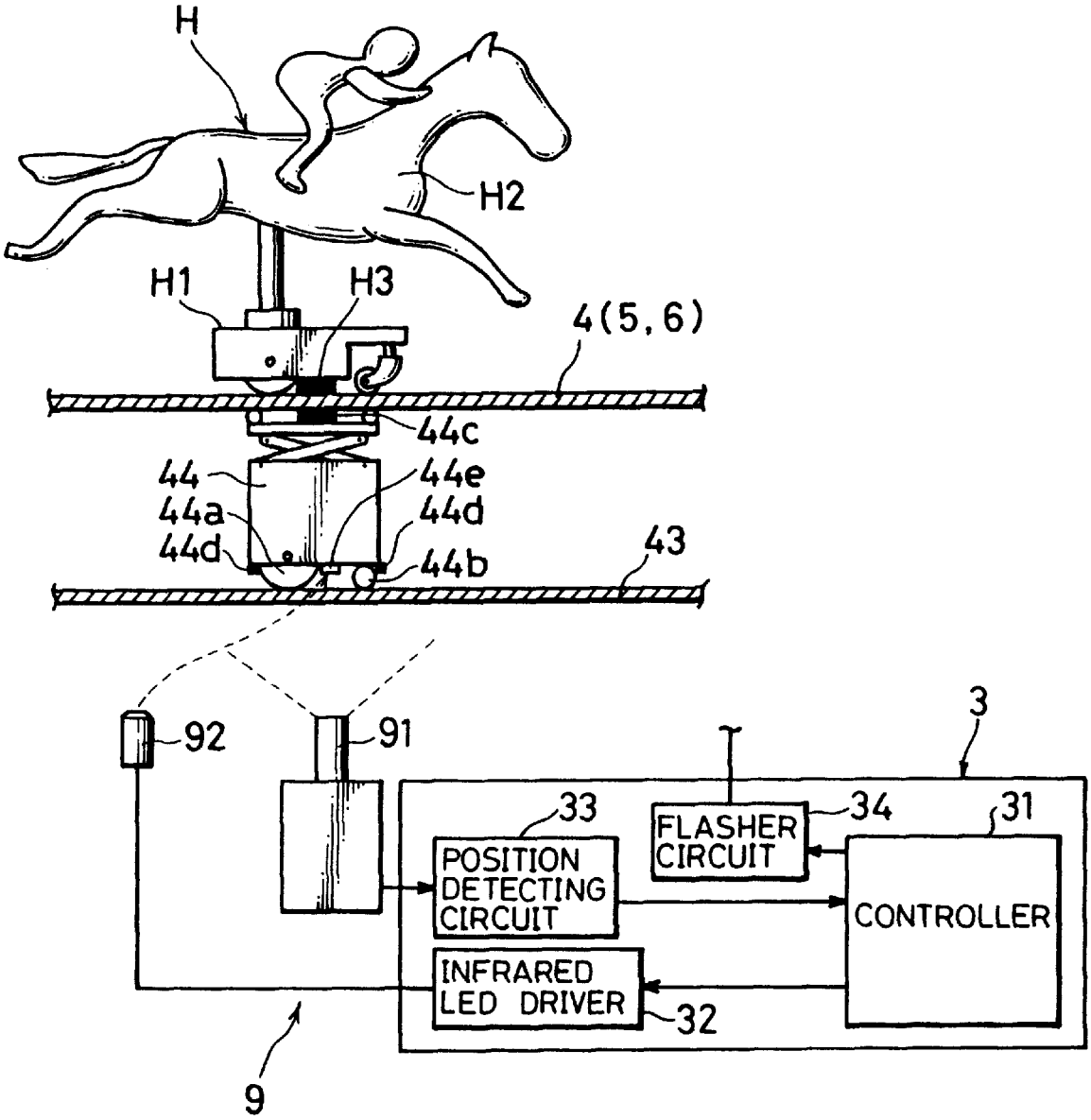
FIG. 5 is a fragmentary side view partially in section illustrating the horse moving mechanism of FIG. 4.

FIG. 4 is a diagram generally illustrating a mechanism for moving the simulated horses H within the field 4 and FIG. 5 is a fragmentary side view partially in section illustrating the horse moving mechanism of FIG. 4. The field 4 is constructed with a synthetic resin board member. Underlying this board member parallel to each other is another board member, or a base plate 43, constructed with a transparent synthetic resin material. A plurality of guiding vehicles 44 are located in a space between the top surface of the base plate 43 and the bottom surface of the board member of the field 4. On the bottom surface of the board member of the field 4, there is formed an array of square-shaped electrodes.

As shown in FIG. 5, each guiding vehicle 44 has on its top surface a plurality of electrode pins elastically protruding upward and arranged on the circumference of a circle of a specified radius, unillustrated right and left driving motors 44*q*1, 44*q*2 (see FIG. 8) each of which is energized through electrode pins 45, 45 (see FIG. 6) which are slidably maintained in contact with each one of the above-mentioned positive or negative electrodes, a pair of laterally aligned driving wheels 44*a* which are rotated by the driving motors, and idle wheels 44*b* which are provided to the front of the driving wheels 44*a*. (It is to be noted that FIG. 5 shows only right-hand driving wheel 44*a* and idle wheel 44*b* since their left-hand counterparts are invisible in this side view.) Each guiding vehicle 44 thus constructed can be turned to the right or left depending on the difference in revolving speeds of the right and left driving wheels 44*a*. When the right and left driving wheels 44*a* of a particular guiding vehicle 44 rotates at the same speed, that guiding vehicle 44 moves straight ahead and its traveling speed is controlled by the revolving speed of the driving wheels 44*a*. Provided at an uppermost position of each guiding vehicle 44 is a generally X-shaped framework (or a pantograph mechanism 44*i*) associated with an unillustrated springy element which exerts an uplifting force on the framework. Further provided on top of the X-shaped framework are rollers for regulating the height of the X-shaped framework and a magnet 44*c* which is kept scarcely out of contact with the bottom surface of the board member of the field 4.

Figure 6:
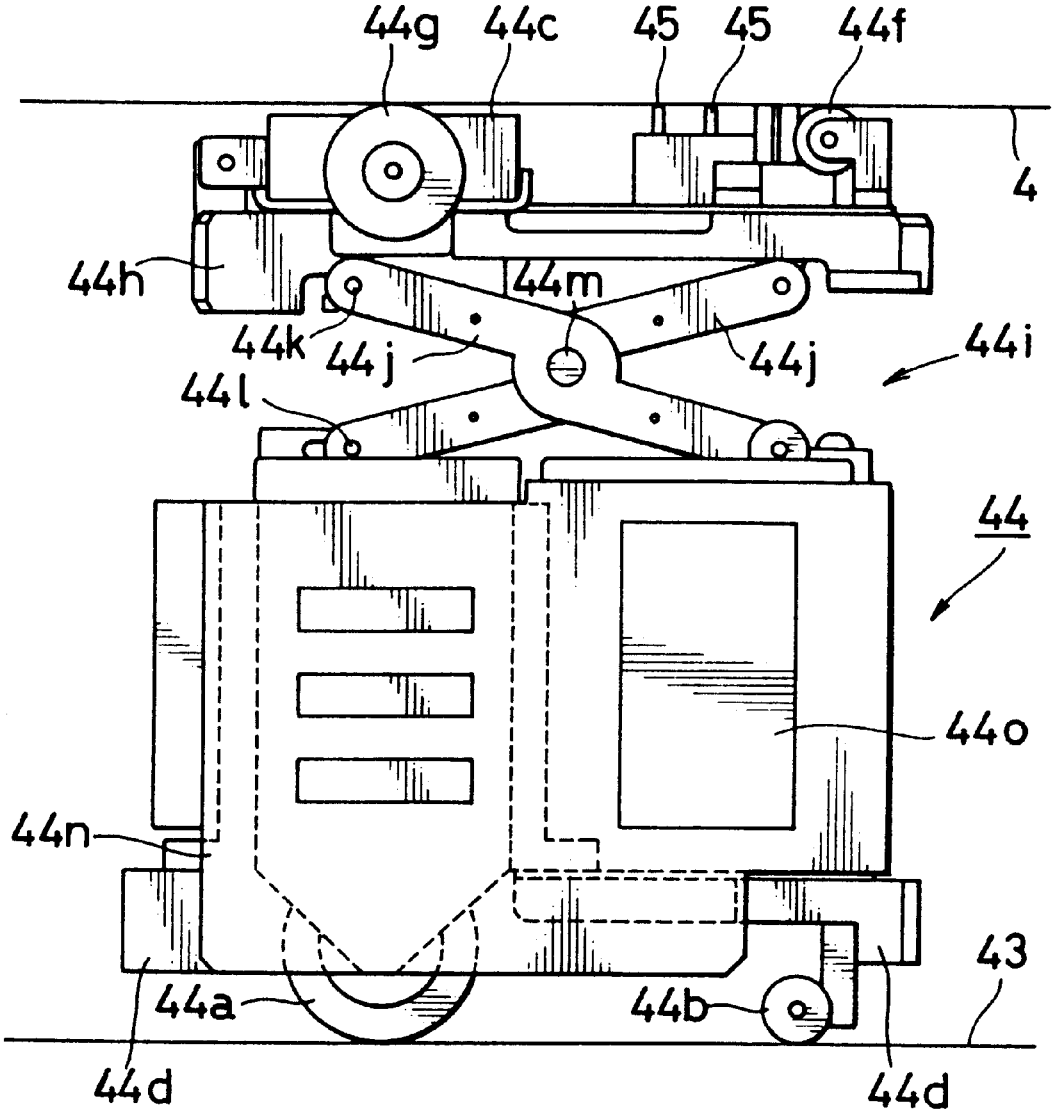
FIGS. 6 and 7 are front and right side views showing an external construction of a guiding vehicle used in this embodiment, respectively.
Figure 7:
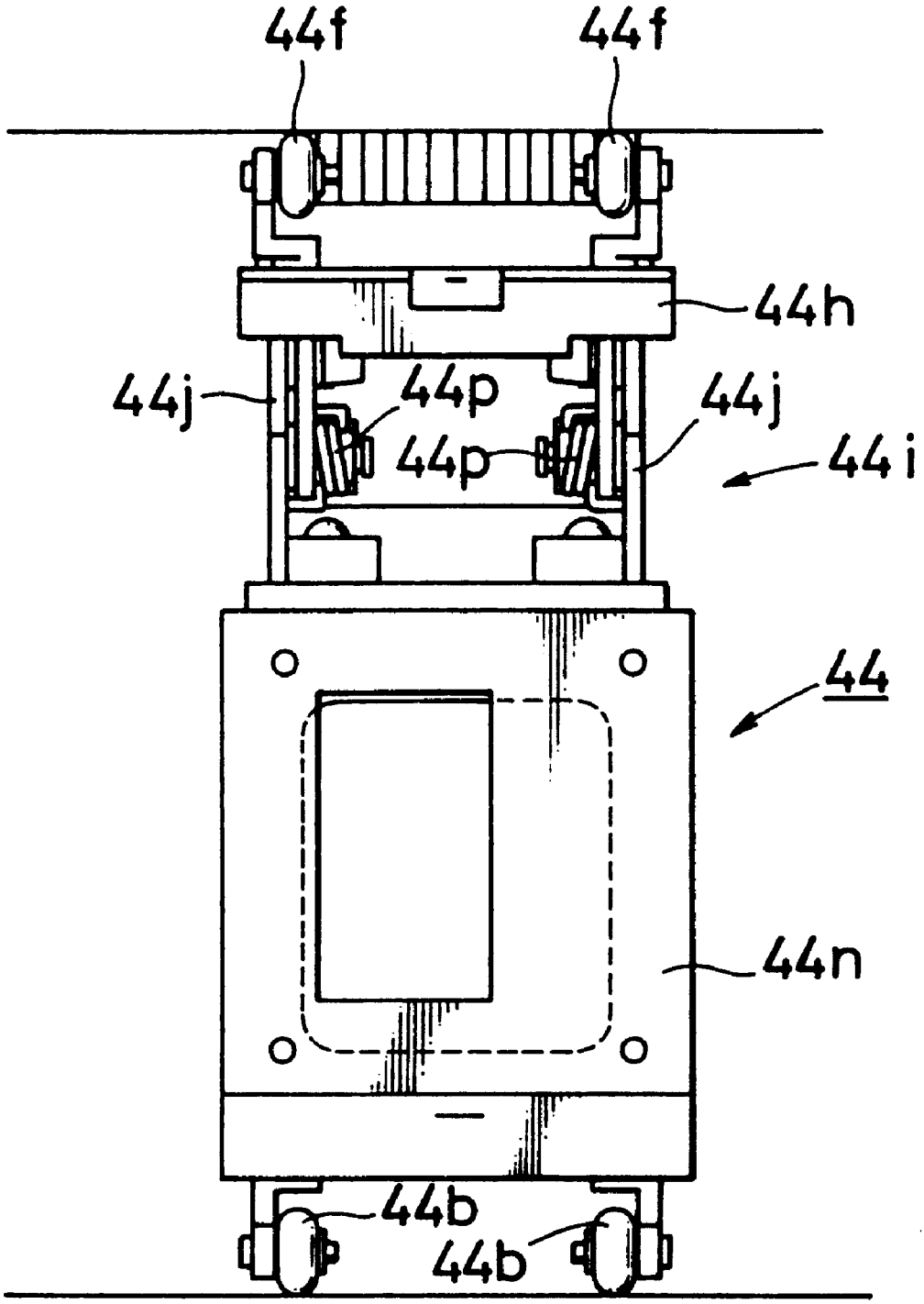

FIGS. 6 and 7 are front and right side views showing the external construction of the guiding vehicle 44. In these FIGURES, indicated at 44*n* is a hollow rectangular casing of the guiding vehicle 44. Casters 44*b* and drive wheels 44*a* are rotatably mounted at a front bottom portion of the casing 44*n* (right side in FIG. 6) and at a rear bottom portion of the casing 44*n* (left side in FIG. 6) with respect to a moving direction of the casing 44*n*. An unillustrated drive shaft of the drive wheels 44*a* are coupled with a motor unillustrated in FIGS. 6 and 7, and the drive wheels 44*a* are driven by this motor. Indicated at 44*o* is a circuitry board housed in the casing 44*n*. A variety of circuits such as a microcomputer to be described later are formed on the base plate 44*o*.

Indicated at 44*h* is an upper base located above the casing 44*n*. The casing 44*n* and the upper base 44*h* are connected via an extensible pantograph mechanism 44*i* such that they move with respect to each other in the vertical direction. The pantograph mechanism 44*i* includes two each of link members 44*j* provided at the upper left and right ends of the casing 44*n*. The opposite ends of each link member 44*j* are connected with the upper part of the casing 44*n* and the lower part of the upper base 44*h* via pins 44*k* and 44*l*, respectively. The two link members 44*j* at the left and right sides are connected in their center via a pin 44*m*, and are biased by a spring 44*p* in such a direction that a distance between the casing 44*n* and the upper base 44*h* becomes larger.

A pair of casters 44*f* and a pair of rollers 44*g* are rotatably mounted at a front portion of the upper base 44*h* and at the left and right sides of the upper base 44*h* with respect to a moving direction of the upper base 44*h*, respectively. The upper ends of the casters 44*f* and the rollers 44*g* are at the same height. As shown in FIG. 2, when the guiding vehicle 44 is disposed between the support plate (or base plate) 43 and the field 4, the upper ends of the casters 44*f* and the rollers 44*g* come into contact with the bottom surface of the field 4 and accordingly rotate as the guiding vehicle 44 runs. A permanent magnet 44*c* is disposed between the rollers 44*g*. The upper end of the permanent magnet 44*c* is set slightly lower than that of the rollers 44*g*. Thus, when the rollers 44*g* are in contact with the bottom surface of the field 4, the permanent magnet 44*c* is spaced apart from this bottom surface by a very small distance.

Indicated at 45 are current collecting electrode members (or an electrode pin) disposed at the front portion of the upper ba se 44h with respect to its moving direction.

Figure 8:
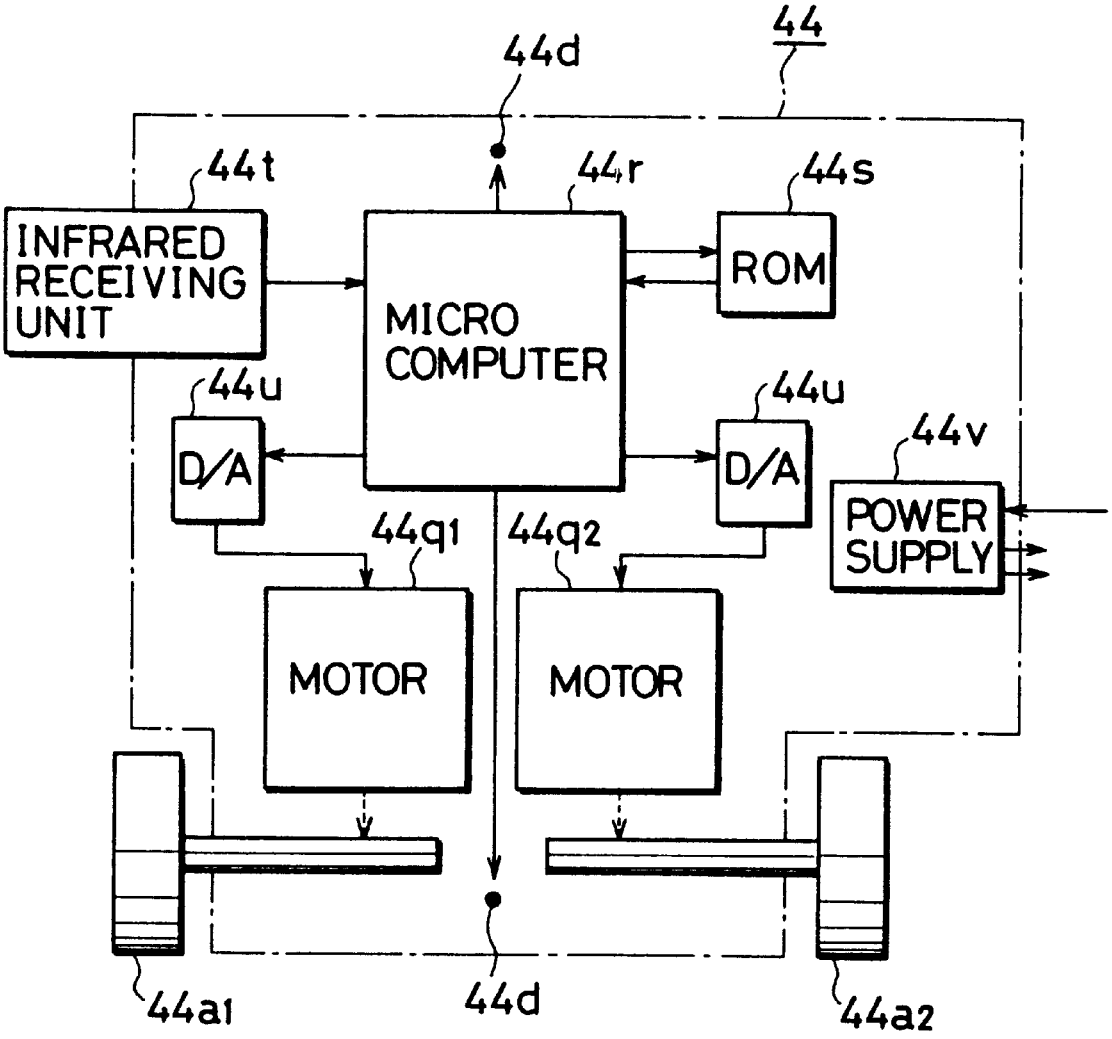
FIG. 8 is a block construction diagram of the guiding vehicle when viewed from above.

FIG. 8 is a block construction diagram of the guiding vehicle when viewed from above.

The guiding vehicle 44 includes a pair of motors 44*q*1, 44*q*2 for independently driving the pair of drive wheels 44*a*1, 44*a*2 of resin or like material. In the description below, the drive wheels 44*a*1, 44*a*2 and the motors 44*q*1, 44*q*2 are indicated at 44*a*, 44*q* respectively unless specified.

In this embodiment, DC motors are used as the motors 46 so that the speed of the guiding vehicle 44 can be duty-controlled and the g u iding vehicle 44 can run backward (by inversion of polarity of a supply current) if necessary. Alternatively, pulse motors may be used so as to enable a speed control using a pulse frequency. Reduction gears are provided in a plurality of positions between a rotatable shaft of the motor 44*q* and that of the drive wheel 44*a* to ensure a specified speed range.

Indicated at 44*r* is a one-chip microcomputer as a controller of the guiding vehicle 44. The microcomputer 44*r* analyzes a signal transmitted from a transmission LED 92 of a control unit 3 to generate a run control signal for the guiding vehicle 44, and causes front and rear LEDs 44*d*, 44*d* for emitting infrared rays. A ROM 44*s* is adapted to store an operation program of the microcomputer 44*r*. Indicated at 44*u* is a digital-to-analog (D/A) converter for converting a digital signal used for a speed control which is output from the microcomputer 44*r* into an analog signal used to drive the motors 44*q*.

The front and rear LEDs 44*d*, 44*d* are disposed at a front center portion and at a rear center portion of the casing 44n (not shown in FIG. 8) of the guiding vehicle 44 such that they are both directed right downward. A frequency band of the infrared rays emitted when the front and rear LEDs 44*d*, 44*d* are turned on corresponds with a transmission frequency band of an infrared filter provided on the front surface of a CCD camera 91 to be described later. Only the infrared rays having a frequency within the transmission frequency band can pass through the infrared filter. The infrared rays passed through the infrared filter are sensed by the CCD camera 91 disposed below the support plate (a base plate) 43. The LEDs 44*d*, 44*d* are fabricated such that the rays propagate over a wide angle. The rays can be sensed by the CCD camera 91 in any arbitrary position on the support plate 43.

Indicated at 44*t* is an infrared ray receiving unit which includes a photodiode or the like for receiving an optical pulse signal transmitted from the transmission LED 92. The unit 44*t* is so disposed as to face downward at the center bottom portion of the casing 44*n* of the guiding vehicle 44. The unit 44*t* is, for example, exposed so as to receive the rays over a wide range. Indicated at 44*v* is a stabilized power supply circuit for generating voltages from the supply voltage supplied from the external power source such as a voltage of 5 V necessary to operate the microcomputer 44*r* and a voltage of 6 V necessary to operate the motor.

Each of the simulated horses H comprises a carrier Hi which is supported by rotatably attached wheels and a horse model H2 which is mounted on the carrier H1 by a supporting bar. A magnet H3 corresponding to the magnet 44*c* of each guiding vehicle 44 is attached to the bottom of the carrier HI in such a way that the two magnets H3, 44*c* are positioned with their opposite magnetic poles facing each other. With this arrangement, each horse H can move around the field 4, following the movement of its corresponding guiding vehicle 44 which travels on the base plate 43.

A pair of lamps 44*d* are mounted at appropriate front and rear locations on the bottom of each guiding vehicle 44. The front and rear lamps 44*d* sequentially flash in this order with a specified small time interval to make it possible to detect the orientation of a particular guiding vehicle 44. Also mounted at an appropriate location on the bottom of each guiding vehicle 44 is an infrared sensing device 44*e* which receives infrared control signals emitted from later-described light-emitting diodes (hereinafter referred to as LEDs) 92. The control signals received by the infrared sensing device 44*e* are sent to an unillustrated control circuit incorporated in each guiding vehicle 44 and used for governing the revolving speeds of the right and left driving motors and their speed differential to control the moving speed and direction of each guiding vehicle 44.

Movements of individual horses H participating in a race run on the track 5 and behaviors of the other horses H in the paddock 6 are controlled by the earlier-mentioned control unit 3 and a sensing system 9 which are provided inside the main body 11 of the competitive game simulation machine 1. The sensing system 9 includes specified numbers of cameras 91 employing charge-coupled devices (hereinafter referred to as CCD cameras) and the LEDs 92 located under the base plate 43.

The control unit 3 includes the controller 31 which produces control signals upon receiving position signals from a below-described position detecting circuit 33 in accordance with a program stored in a read-only memory (hereinafter referred to as ROM) provided for controlling the progress of each game, an infrared LED driver 32 which transmits control signals received from the controller 31 to the LEDs 92, the position detecting circuit 33 which detects the positions and orientations of the individual horses H and inputs such information to the controller 31 based on sensing signals obtained from the CCD cameras 91 monitoring the front and rear lamps 44*d* of the guiding vehicles 44, and a flasher circuit 34 for supplying drive pulses to the racecourse guide lamps 8 which are constructed with LEDs, for example, at specified time intervals in accordance with control signals received from the controller 31. The lamps 44*d* flash in a particular sequence with small time delays from one guiding vehicle 44 to another. This time-sequential flashing pattern enables the control unit 3 to identify the individual guiding vehicles 44.

The controller 31 is programmed to periodically execute individual races determined by combinations of the course numbers shown in Table 1 and the types of race shown in Table 2, which are stored in the ROM, in a specific order on condition that the players have made their bets. If betting operation has not been done, a race is not run to prolong the operational life of each driving mechanism, for instance.

Described below is how each simulated race is executed. When a type of race has been determined with reference to the data shown in Tables 1 and 2, the controller 31 transmits control signals in accordance with the selected type of race to those horses H which have specified horse numbers via the LEDs 92. These control signals cause the relevant horses H to proceed to a specified starting gate 7 and enter their specified booths 71.

The individual horses H are caused to run on the track 5 when a start signal is transmitted. The horses H located on the track 5 at the end of a race move in accordance with control signals sequentially transmitted from the LEDs 92. More specifically, the horses H return to the paddock 6 through one of the passageways 63 and those horses H which will not participate in a next race enter empty waiting spaces 610 of the waiting zone 61 by way of the looping course 62.

Although not depicted in FIGS. 4 and 5, the controller 31 can transmit control signals to the individual starting gates 7 as well. These control signals cause, for example, one of the third and fourth starting gates 7*c*, 7*d* to be set in its operating position and the other stored in its storage space or both of them stored in their storage spaces depending on the course number selected from Table 1.

Distribution functions which define average running speeds and sprinting abilities of individual horses H participating in a race are entered into the controller 31. The controller 31 calculates actual speeds and sprinting forces of the horses H during the race based on random numbers generated at specific time intervals from the distribution functions, and the horses H are caused to run in accordance with the calculation results. Also entered into the controller 31 is information on each simulated horse's running style, which determines whether a particular horse H is of a type which attempts to take the lead in an early stage of a race or of a type which puts on a finishing spurt, for example. This information is also reflected in the progress of each race.

Described next is how the controller 31 controls movements of the individual horses H in the paddock 6. The horses H which have finished the race are caused to line up in their finishing order and proceed to the paddock 6. As the horses H participating in a next race are already determined at this point, the horses H returning to the paddock 6 go through a passageway 63 which is on the opposite side of the starting gate 7 to be used in the next race. Upon returning to the paddock 6, horses H which will participate in the next race turn to the front side of the waiting zone 61 whereas horses H which will not run the next race proceed to the rear side of the waiting zone 61 and sequentially enter those waiting spaces 610 which are empty and closest to the center of the waiting zone 61.

Among the horses H participating in the next race, those which are positioned in the waiting zone 61 proceed in sequence toward the passageway 63 on the side of the next starting gate 7 specified through the front side of the looping course 62 at first, and those which ran the preceding race proceed to the specified starting gate 7 through the looping course 62 and the opposite passageway 63 next.

Behaviors of the individual horses H in the paddock 6 is determined with reference to an average value of the aforementioned distribution functions. Specifically, horses H having distribution functions with high average values actively move around the paddock 6 while those having distribution functions with low average values show slow movements. Alternatively, the individual horses H are so controlled that they exhibit behaviors suggestive of their characteristics as data on such characteristics is randomly referred to. The players can make their betting decisions with reference to pre-race behaviors of the individual horses H. This arrangement helps produce realistic feelings.

Figure 9:
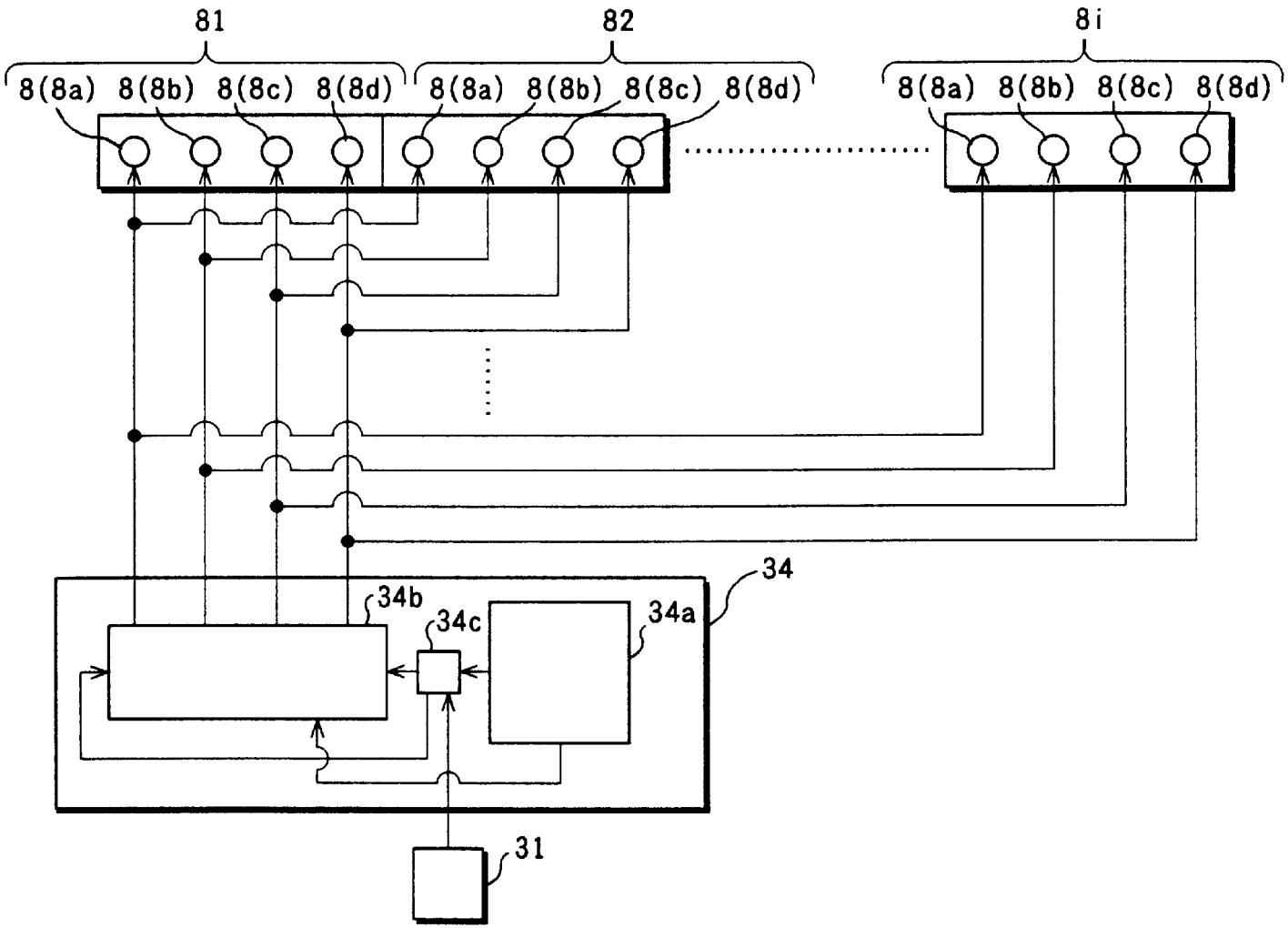
FIG. 9 is a block diagram illustrating a circuit configuration for controlling a racecourse guide lamp flashing sequence.

FIG. 9 is a block diagram illustrating a circuit configuration fo r controlling the flashing sequence of the racecourse guide lamps 8. Depicted as an example in this Figure are the racecourse guide lamps 8 provided along the bank 41 of the long-distance track 5*b*. These racecourse guide lamps 8 are arranged in a series of guide lamp arrays, each array including a first guide lamp 8*a*, a second guide lamp 8*b*, a third guide lamp 8*c* and a fourth guide lamp 8*d* which are positioned side by side in a horizontal plane at equal intervals. Intervals between the first and fourth guide lamps 8*a*, 8*d* of adjacent guide lamp arrays are also made equal to the intervals between the guide lamps 8*a*–8*d* within each array. As shown in FIG. 9, there are i ("i" is an integer larger than 3) guide lamp arrays, that is, a first guide lamp array 81, a second guide lamp array 82, . . . and an ith guide lamp array 8*i* mounted in series on the inside wall of the bank 41. The players can recognize the currently selected course and horse-running direction as the first to fourth guide lamps 8*a*–8*d* of each guide lamp array (81, 82 . . . , 8*i*) flash in sequence at the specified time intervals in the horse-running direction on the current course.

The flasher circuit 34 comprises a pulse generator 34*a* which outputs a clock signal and a reference pulse signal obtained by dividing the frequency of the clock signal by four, a delay circuit 34*b* including a 4-bit shift register, and a switch 34*c* connected between the pulse generator 34*a* and delay circuit 34*b*. The switch 34*c* is provided for switching between alternative input terminals of the delay circuit 34*b* for reference pulses in accordance with a control signal fed from the controller 31. The delay circuit 34 bout puts pulse currents to the individual racecourse guide lamps 8 with sequential time delays in normal or reverse order depending on which input terminal is selected by the switch 34*c*.

More particularly, if the switch 34*c* is set so that the reference pulse signal fed from the pulse generator 34*a* is supplied to the delay circuit 34*b* through its left-hand input terminal (as illustrated in FIG. 9), reference pulses are cyclically outputted to the first guide lamp 8*a*, second guide lamp 8*b*, third guide lamp 8*c* and fourth guide lamp 8*d* of each guide lamp array (81, 82 . . . , 8*i*) in this order at clock pulse repetition intervals. As the racecourse guide lamps 8 flash in synchronism with the reference pulses, flashes of light cyclically shift from the first guide lamp 8*a* to the fourth guide lamp 8*d* on each guide lamp array (81, 82 . . . , 8*i*). This enables the players to recognize that the horse-running direction on the currently selected course is from the first to fourth guide lamps 8*a*–8*d*.

On the contrary, if the switch 34*c* is set so that the reference pulse signal fed from the pulse generator 34*a* is supplied to the delay circuit 34*b* through its right-hand input terminal (as illustrated in FIG. 9), reference pulses are supplied to the fourth guide lamp 8*d*, third guide lamp 8*c*, second guide lamp 8*b* and first guide lamp 8*a* of each guide lamp array (81, 82 . . . , 8*i*) in this order at the clock pulse repetition intervals. In this case, flashes of light cyclically shift from the fourth guide lamp 8*d* to the first guide lamp 8*a* on each guide lamp array (81, 82 . . . , 8*i*) and the players can recognize that the horse-running direction on the currently selected course is from the fourth to first guide lamps 8*d*–8*a*.

Although the pulse generator 34*a* is set to output reference pulses at a repetition interval of 0.4 second and clock pulses at a repetition interval of 0.1 second in this embodiment, the invention is not limited thereto. What is required when each guide lamp array has n ("n" is an integer larger than 2) racecourse guide lamps 8 (i.e., first to nth racecourse guide lamps) is that the interval between successive reference pulses should be made n times longer than the interval between the clock pulses. The clock pulse interval is not necessarily limited to 0.1 second either. It may be set to any appropriate value in accordance with the type of race or traveling speeds of individual moving objects. In another alternative, the clock pulse interval may be made variable between the first and second halves of a race or in accordance with degrees of excitement in a sequence of racing scenes.

Described above is how the flashing sequence of the racecourse guide lamps 8 provided along the bank 41 of the long-distance track 5*b* is controlled. Since the racecourse guide lamps 8 provided along the periphery of the central separating zone 51 and the edges of the separating zone 52 are also controlled in a similar flashing sequence, the players can easily recognize the currently selected course and horse-running direction.

The paddock 6 is provided with the waiting zone 61 for accommodating non-participating horses H. This arrangement make it possible to run a 6-horse race, an 8-horse race, and so on among properly selected horses without leaving non-participating horses H on the track 5 so that each race on the track 5 can be run in a more realistic manner compared to the conventional competitive game simulation machines.

Although the invention has thus far been described with reference to its preferred embodiment which employs the horses H as moving objects, other kinds of moving objects may be used instead of the horses H. To cite a few examples, the moving objects may be formed in the shape of racing cars, racing bicycles or even players of soccer or other ball games.

Although the competitive game simulation machine 1 of the foregoing embodiment is provided with the choice of two racecourses, i.e., the short-distance track 5*a* and long-distance track 5*b*, the invention is not limited to this configuration. There may be provided more than two racecourses on the track 5 by properly arranging separating zones and mounting the flashing racecourse guide lamps 8 on both sides of the individual racecourses.

Furthermore, the border between the main area and the auxiliary area can be just a line drawn in the game board.

Although the present invention has been fully described by way of example with reference to the accompanying drawings, it is to be understood that various changes and modifications will be apparent to those skilled in the art without departing fromthespiritandscopeofthepresentinvention. Accordingly, the invention should not be limited by the foregoing description but rather should be defined only by the following claims.

What is claimed is:

1. A competitive game simulation machine comprising:

a plurality of moving objects;

a game board on which the plurality of moving objects are to be placed; the game board including:

a main area used for moving objects to compete a specified game;

an auxiliary area with moving objects which will not compete in the specified game, the moving objects movable between the main area and the auxiliary area;

a controller for controlling motions of the moving objects on the game board.

2. A competitive game simulation machine according to claim 1, wherein the controller is set such that those of the moving objects which will participate in the specified game move into the main area and the rest of the moving objects stay within said auxiliary area.

3. A competitive game simulation machine according to claim 1, wherein the auxiliary area has a sufficient space such that the auxillary permits a change in orientation of the moving objects.

4. A competitive game simulation machine according to claim 1, wherein a track is formed in the main area to allow moving objects to compete the specified game.

5. A competitive game simulation machine according to claim 2, wherein the auxiliary area has a waiting zone in which moving objects not participating in the specified game can be kept in a standby state.

6. A competitive game simulation machine according to claim 5, wherein a passageway is formed between the playing area and the auxiliary area and through the passageway the moving objects can move between the playing area and the auxiliary area.

7. A competitive game simulation machine according to claim 6, wherein said waiting zone is arranged parallel to a linear boundary between the main area and the auxiliary area and includes a plurality of waiting spaces in which the moving objects not participating in the specified game can be aligned side by side in a longitudinal direction of the waiting zone, and a loop paddock course surrounding the waiting zone is formed in the auxiliary area and said paddock course includes an exit-side portion which is closer to the boundary between the main area and the auxiliary area and an entrance-side portion located opposite to the exit-side portion, wherein the controller is set such that moving objects leaving the waiting zone proceed to the main area by way of the exit-side portion of the paddock course and moving objects returning to the waiting zone proceed thereto by way of the entrance-side portion of the paddock course.

8. A competitive game simulation machine according to claim 7, wherein the moving object controller is set such that the moving objects returning to the waiting zone sequentially enter those waiting spaces which are empty and closest to the center of the waiting zone.

9. A competitive game simulation machine according to claim 8, wherein the moving objects are formed in shapes resembling actual racehorses.

10. A competitive game simulation machine according to claim 9, wherein the specified game is a horse racing game.

11. A competitive game simulation machine according to claim 1, wherein the controller is set such that moving objects in the auxiliary area are capable of moving at different speeds from each other.

* * * * *